United States Patent [19]

Cahill et al.

[11] Patent Number: 4,986,284

[45] Date of Patent: Jan. 22, 1991

[54] CIGARETTE MANUFACTURE

[75] Inventors: Michael J. Cahill; John Dawson, both of Coventry; Brian H. Warner, Bucks, all of England

[73] Assignee: Molins PLC, London, England

[21] Appl. No.: 305,553

[22] Filed: Feb. 3, 1989

[30] Foreign Application Priority Data

Feb. 10, 1988 [GB] United Kingdom ..... 8802975
Oct. 11, 1988 [GB] United Kingdom ..... 8823821

[51] Int. Cl.[5] ..... A24C 5/60

[52] U.S. Cl. ..... 131/88; 131/90; 131/79; 131/362

[58] Field of Search ..... 131/88, 90, 79, 362, 131/81

[56] References Cited

U.S. PATENT DOCUMENTS 4,619,276 10/1986 Albertson et al. ..... 131/31
4,785,831 11/1988 Hinchcliffe et al. ..... 131/88

*Primary Examiner*—V. Millin
*Attorney, Agent, or Firm*—Antonelli, Terry, Stout & Kraus

[57] ABSTRACT

Apparatus for applying adhesive foam or other liquid-based ingredients to the ends of cigarettes includes a source of suction, a device for carrying and moving a series of flexible tubular sealing members 50 each of which is aligned with a respective cigarette in a treatment station, and an arrangement for moving each sealing member into engagement with a respective cigarette and for connecting each sealing member to the source of suction, characterised in that each sealing member is so shaped that an end portion 54 thereof can engage around the end portion of the corresponding cigarette, and that suction transmitted through the sealing member causes the end portion of the sealing member to contract and thus grip the cigarette. A pressure air source may also be included to expand each sealing member as it moves over the end of the corresponding cigarette.

13 Claims, 2 Drawing Sheets

CIGARETTE MANUFACTURE

This patent application is concerned with improvements with respect to the inventions described in our U.S. Pat. No. 4,785,831 and U.S. Pat. No. 4,856,536 which relate to the application of adhesive-containing foam to the ends of cigarettes. The present application is mainly concerned with improved or alternative ways of applying suction to the interior of the cigarettes to cause or promote the entry of foam into the cigarette ends. However, it is more generally applicable to the introduction of any liquid ingredient into the ends of cigarettes; the liquid ingredient may, for example, be projected onto the cigarette ends in measured quantities by a device similar to an ink jet printer as described in our earlier patent, and the liquid may for example contain an adhesive or a flavoring material or a combination of both.

Apparatus according to one aspect of this invention comprises means for conveying cigarettes sideways through a treatment station in which a quantity of the liquid ingredient is transferred to the end of each cigarette, a source of suction, means for carrying and moving a series of tubular sealing members each of which is aligned with a respective cigarette in the treatment station, and means for moving each sealing member into engagement with a respective cigarette and for connecting each sealing member to the source of suction, characterized in that each sealing member is so shaped that an end portion thereof can engage around the end portion of the corresponding cigarette, and that suction transmitted through the sealing member causes the end portion of the sealing member to contract and thus grip the cigarette.

A preferred arrangement includes a source of pressure air and means for connecting the pressure air to the interior of each sealing member, as the sealing member is moved towards engagement with a corresponding cigarette, whereby the sealing member is expanded by the air pressure so as to facilitate movement of the end of the sealing member over the end of the corresponding cigarette.

According to another aspect of this invention, apparatus for introducing a liquid ingredient into the ends of cigarettes comprises means for conveying cigarettes sideways through a treatment station in which a quantity of the liquid ingredient is transferred to the end of each cigarette, comprising a fluted drum having parallel flutes for carrying therein respective cigarettes through the treatment station, the flutes having a depth greater than the diameter of the cigarettes whereby the cigarettes are entirely contained within the flutes, a stationary cover plate extending around the drum in the region of the treatment station for substantially enclosing the cigarettes in chambers formed by the respective flutes, and a source of suction communicating with the chambers via passageways in the drum, whereby substantially the entire periphery of each cigarette is surrounded by suction so as to induce an inflow of air through the end of the cigarette to which the liquid ingredient is applied and so as to draw the liquid ingredient into the cigarette.

Apparatus according to another aspect of the invention comprises a fluted drum for conveying cigarettes sideways through a treatment station in which a quantity of the liquid ingredient is transferred to the end of each cigarette, each flute having one or more relatively deep portions forming one or more suction chambers for drawing air through the adjacent parts of the cigarette wrapper, each relatively deep portion being terminated, at positions spaced along the flute, by walls having concave edges matching the radius of the cigarettes so as to seal against excessive leakage of suction.

Other aspects of this invention, and possible combinations of the abovementioned aspects of this invention, are described below.

Examples of apparatus according to this invention are shown in the accompanying drawings. In these drawings.

Figure 1:
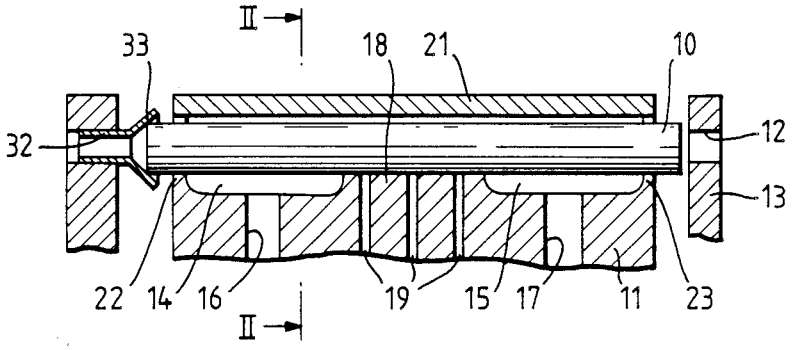
FIG. 1 is a longitudinal sectional view illustrating diagrammatically one form of apparatus.

FIG. 1, cigarettes 10 are arranged to be

With reference to FIG. 1, cigarettes 10 are arranged to be carried by a fluted drum 11 while the right-hand end of each cigarette receives adhesive foam from an aligned aperture 12 in a circular plate 13 coaxial with the drum. In order to draw each corresponding quantity of foam into the cigarette, or to promote the movement of the foam into the cigarette (i.e. assisting the possible air jets applied in accordance with the above-mentioned specifications), a suction chamber is formed around each cigarette. Each chamber comprises, in the example shown, two main portions 14 and 15 which communicate via passages 16 and 17 with a suction source within the drum. Suction is also transmitted around most of the periphery of the cigarette in the region between the chambers 14 and 15 as will be understood from the following description.

Figure 2:
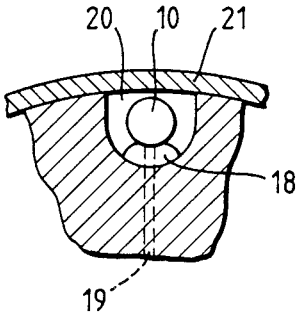
FIG. 2 is a section on the line II—II in FIG. 1.

A narrow raised portion 18 within each flute of the drum engages the adjacent peripheral portion of the cigarette and has passageways 19 through which suction is transmitted to hold the cigarette firmly on the drum, i.e. in engagement with the raised portion 18 of the drum. As shown in FIG. 2, each raised portion 18 is narrow so as to engage only part of the periphery of the cigarette and thus permit suction to be applied around the remainder of the periphery of the cigarette via a space 20 which communicates with the chambers 14 and 15.

The suction chambers around the cigarette are completed by a stationary curved plate 21 extending around the drum and having a close running clearance with respect to end flanges 22 and 23 on the drum. Thus this arrangement is to be contrasted with that described in our above-mentioned patent application according to which suction is transmitted via a cowl or plate around the drum.

Figure 4:
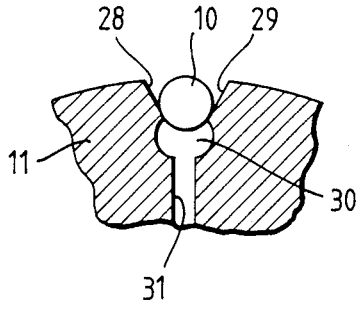
FIG. 4 is a fragmentary sectional view of an alternative form of apparatus for applying suction to the interior of the cigarettes.
Figure 6:
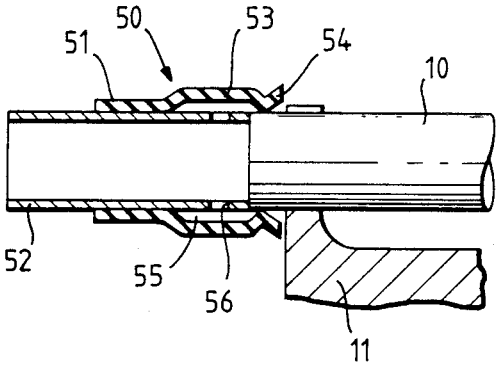
FIG. 6 is a fragmentary longitudinal section through part of another form of apparatus for applying suction to the ends of the cigarettes.

FIG. 1 also illustrates a tubular sealing member 32 with a conical end portion 33 through which suction may be applied to the end of the cigarette in both the FIG. 1 example and in the FIG. 4 example. FIG. 6 shows an alternative tubular seal.

Figure 3:
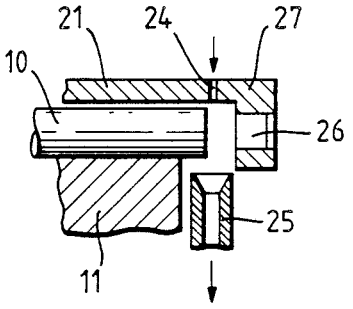
FIG. 3 illustrates an arrangement for drying the cigarettes.

After the transfer of foam onto each cigarette end has been completed, any excess foam protruding from the cigarette end may be removed in the manner illustrated by FIG. 3. That is to say, an extension of the cowl 21 may be formed with a radial passage 24 to which compressed air is applied from an exterior manifold (not shown) to produce an air jet extending radially towards the axis of the drum. The air jet Passes close to the ends of the cigarettes and blows any excess foam into a collector tube 25 through which the foam is drawn away under gravity or with the aid of suction.

FIG. 3 also illustrates a possible arrangement for drying the foam so as to set or partially set the adhesive contained in the foam. For that purpose one or more infra-red heating devices 26 are mounted in a flange 27 so as to direct infra-red beams axially towards the cigarette ends. This increases the rate of vaporization of moisture from the foam. The air jet assists in the removal of the vapor; for that purpose it should be of a velocity such as to create turbulence and thus minimize the boundary layer at the end face of the cigarettes.

The arrangement shown in FIG. 3 assumes that the plate 13 is a form of swashplate so as to rotate about an axis inclined to that of the drum and thus allow space for the parts shown in FIG. 3. Alternatively the drying of the cigarettes in the manner shown in FIG. 3 may be effected while the cigarettes are being carried by a further drum.

FIG. 4 illustrates an alternative arrangement for applying suction to the periphery of each cigarette. Each flute of the drum 11 carrying the cigarettes 10 is formed with converging surfaces 28 and 29 which engage the sides of the cigarette. Inward extensions of the surfaces 28 and 29 define an inner chamber 30 which extends around just under half of the periphery of the cigarette and communicates with a suction source via one or more passages 31. Thus suction applied to the passages 31 will also serve to hold the cigarettes on the drum. It will be understood furthermore that portions of the drum at the axial ends of the chamber 30 form walls having concave edges matching the radius of the cigarettes so as to seal against excessive leakage of suction from the chamber.

Figure 5:
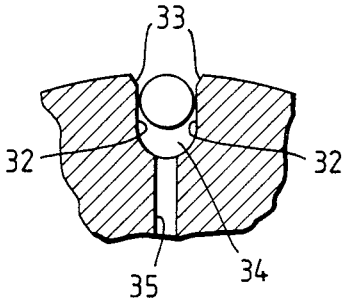
FIG. 5 is similar to FIG. 4 but shows a modification.

FIG. 5 shows an arrangement similar to FIG. 4, but in this case each flute has parallel sides 32 with flared entry portions 33, the sides being spaced apart by a distance slightly greater than the cigarette diameter. At the ends of the flute 34, there are walls having concave edges for sealing the suction chamber formed by the flute and for supporting the cigarette. There may be one or more additional walls for supporting the cigarette at intermediate positions along its length. Suction is supplied through one or more radial passages 35. In this example, in contrast with FIG. 4, suction is transmitted through exactly half the periphery of each cigarette for drawing in the foam or other liquid ingredient applied to one end of the cigarette. Suction may also be applied to the other end of the cigarette in the manner described with reference to FIG. 1 or FIG. 6, to increase the flow of air into the end of the cigarette which receives the foam.

FIG. 6, shows a tubular sealing member 50 including an end Portion 51 which is secured around a rigid tube 52, a larger diameter portion 53, and a portion which extends beyond the end of the tube 52 and includes a flared end 54 for guiding the corresponding cigarette into the tube. In use, each cigarette is pushed towards the tubular seal 50; alternatively the cigarette might remain stationary with respect to the drum 10 while a member (e.g. in the form of a swashplate) carrying the tubes 52 moves the tubular seals towards the cigarettes. In either case, relative movement between each cigarette and the corresponding tubular seal causes the cigarette to enter into the seal. While it is doing so, air at slightly above atmospheric Pressure may be supplied to the tube 52 so as to enter the annular space 55, via openings 56 in the tube 52, and expand the right-hand end of the seal slightly so as to facilitate the entry of the cigarette into the seal. A suitable manifold (not shown) may communicate with the respective tubes 52 for that purpose. A further part of the manifold may serve to supply suction to the tubes so as to draw air through the cigarette and thus cause or assist the drawing of foam into the far ends of the cigarettes. The suction also causes each tubular seal to contract slightly so as to grip the end of the cigarette.

Afterwards, while each cigarette is being removed from the corresponding tubular seal, air at above atmospheric pressure may be supplied again to the tubes 52 to expand the end of the tubular seal.

By way of example, the above-atmospheric air pressure may be approximately 2 p.s.i. The tubular seals may be made of any suitable rubbery material, for example that sold under the trademark "ISOPRENE". The thickness of the wall of the tubular seal may, for example, be 0.9 mm.

In the example shown in FIG. 6, the end portion 51 may be of the same diameter as the portion 53, the portion of the rigid tube 52 lying within the portion 51 then having an appropriately enlarged external diameter.

The ends of the cigarettes to which foam is applied may be arranged to abut the apertured plate 13 (e.g. as shown in FIG. 1). For that purpose, the pressure air supplied through the tube 52 may serve to blow each cigarette into abutment with the plate, each cigarette then being possibly locked into position axially on the drum by means of suction passageways such as the passageways 19 shown in FIG. 1. In such an arrangement, as already mentioned, the tubes 52 may be mounted on a swashplate rotating about an axis inclined slightly to that of the drum. After each quantity of foam has been transferred to the corresponding cigarette end, suction may continue to be applied to the tubes 52 while the tubes move axially with respect to the drum, so that the tubular seals 50 will pull the cigarettes axially away from the apertured plate, possibly against the resistance of gripping suction applied through the passages 19. After each cigarette has thus been spaced from the apertured plate, above-atmospheric air is supplied to the tubes 52 to expand the tubular seals and thus permit further movement of the tubes 52 to separate the tubular seals from the cigarettes. Thereafter the cigarettes can readily be transferred to a further fluted drum, their ends being spaced respectively from the apertured plate and tubular seals.

Figure 7:
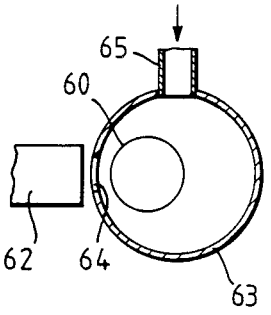
FIG. 7 shows an alternative arrangement for drying the cigarettes.

FIG. 7 shows another arrangement for drying the ends of the cigarettes after the application of foam or other liquid-based material. It is based upon a tubular quartz halogen lamp 60 (shown in cross-section) which is powered at a voltage below that used for light emission, so that it emits a high proportion of infra-red radiation for drying the ends of cigarettes 62. A tubular casing 63 surrounds the lamp 60 and is gold plated for reflecting the radiation towards the cigarettes; it has a slot 64 which is arcuate (when viewed from the left of the casing 63) so as to extend approximately parallel to the path of the cigarette ends along a distance of several centimeters. Air at above atmospheric pressure is blown into the tubular casing through an inlet pipe 65; after swirling around the lamp, the air passes out through the slot 64, carrying heat from the lamp towards the cigarettes and generally promoting the drying of the cigarettes while cooling the lamp 60.

We claim:

1. Apparatus for introducing a liquid ingredient into the ends of cigarettes, comprising means for conveying cigarettes sideways through a treatment station in which a quantity of the liquid ingredient is transferred to the end of each cigarette, a source of suction, means for carrying a series of flexible tubular sealing members so that each of said sealing members is aligned with a representative cigarette in the treatment station, and means for moving each sealing member into engagement with a respective cigarette and for connecting each sealing member to the source of suction, each sealing member being so shaped that an end portion thereof can extend over and engage around the end portion of the corresponding cigarette at a position spaced inwardly from the end face of the cigarette, and being sufficiently flexible that suction transmitted through the sealing member causes the end portion of the sealing member to contract and thus grip the cigarette at said inwardly spaced position on the cigarette.

2. Apparatus according to claim 1, including a source of pressure air and means for connecting the pressure air to the interior of each sealing member, as the sealing member is being moved towards engagement with a corresponding cigarette, for urging outwardly the portion of the sealing member which extends over the end portion of the cigarette, whereby the sealing member is expanded by the air pressure so as to facilitate movement of the end of the sealing member over the end of the corresponding cigarette.

3. Apparatus for introducing a liquid ingredient into the ends of cigarettes, comprising means for conveying cigarettes sideways through a treatment station in which a quantity of the liquid ingredient is transferred to the end of each cigarette, a source of suction, a source of pressure air, means for carrying a series of tubular sealing members of flexible material each of which is aligned with a respective cigarette in the treatment station, and means for moving each sealing member into engagement with a respective cigarette and for connecting each sealing member to the source of suction, characterized in that each sealing member is so shaped that an end portion thereof can extend over and engage around the end portion of a corresponding cigarette, and that pressure air is arranged to be fed to each sealing member as it approaches the corresponding cigarette, to urge outwardly the end portion of the sealing member which is adapted to extend over the end portion of the corresponding cigarette, thus expanding the end portion of the sealing member so as to facilitate movement of the sealing member over the end of the cigarette, the supply of pressure air being arranged subsequently to discontinue and to be replaced by suction from the suction source for drawing the liquid ingredient into the cigarette.

4. Apparatus according to claim 3 in which each sealing member is so shaped that suction transmitted through it for drawing the liquid ingredient into the corresponding cigarette tends to cause the sealing member to collapse so as to grip the end of the cigarette firmly.

5. Apparatus according to any one of claims 1 to 4, in which each tubular sealing member is mounted around a substantially rigid tube so as to project beyond an end of the rigid tube which is adapted to engage the corresponding cigarette so as to determine the axial position of the cigarette when it receives the liquid ingredient.

6. Apparatus according to any one of claims 1 to 4, in which the portion of each sealing member which is adapted to engage around a corresponding cigarette has an internal diameter substantially equal to or slightly less than that of the cigarette, with a flared portion to facilitate movement of the tubular member over the end of the cigarette, in which the end portion of the sealing member includes an intermediate portion of larger internal diameter which partly defines an annular chamber for receipt of suction for contracting the sealing member for gripping and thus sealing around the cigarette.

7. Apparatus according to claim 1 including means for drying the cigarette ends by microwave radiation.

8. Apparatus for introducing a liquid ingredient into the ends of cigarettes, comprising means for conveying cigarettes sideways through a treatment station in which a quantity of the liquid ingredient is transferred to the end of each cigarette, comprising a fluted drum having parallel flutes for carrying therein respective cigarettes through the treatment station, the flutes having a depth greater than the diameter of the cigarettes whereby the cigarettes are entirely contained within the flutes, a stationary cover plate extending around the drum in the region of the treatment station for substantially enclosing the cigarettes in chambers formed by the respective flutes, and a source of suction communicating with the chambers via passageways in the drum, whereby substantially the entire periphery of each cigarette is surrounded by suction so as to induce an inflow of air through the end of the cigarette to which the liquid ingredient is applied and so as to draw the liquid ingredient into the cigarette.

9. Apparatus according to claim 8, in which each flute of the drum has a raised portion onto which the cigarette is suctionally gripped by suction applied through passages in the raised portion separate from one or more additional passages to which suction is transmitted to the space around the cigarette for drawing in air through the end of the cigarette.

10. Apparatus according to claim 9, including means for applying suction pressure to the end of each cigarette remote from the end to which the liquid ingredient is applied, to assist in drawing the liquid ingredient into the cigarette.

11. Apparatus for introducing a liquid ingredient into the ends of cigarettes, comprising a fluted drum for conveying cigarettes sideways through a treatment station in which a quantity of the liquid ingredient is transferred to the end of each cigarette, each flute having one or more relatively deep portions forming one or more suction chambers for drawing air through the adjacent parts of the cigarette wrapper, each relatively deep portion being terminated, at portions spaced along the flute, by walls having concave edges matching the radius of the cigarettes so as to seal against excessive leakage of suction.

12. Apparatus for treating the ends of cigarettes with a liquid ingredient, including means for conveying cigarettes sideways through a treatment station in which a quantity of the liquid ingredient is transferred to the end of each cigarette, and means for drying the ends of the cigarettes comprising a radiation device mounted adjacent to the path of the cigarette ends for directing radiation towards the cigarette ends, a cowl mounted around the radiation device, and means for introducing pressure air into a space between the device and the cowl, the arrangement being such that the air introduced into the said space cools the radiation device and then flows out towards the cigarette ends, thus promoting the drying of the cigarette ends.

13. Apparatus according to claim 12 in which the radiation device is a halogen lamp.

* * * * *